US008663769B2

(12) United States Patent
Zhang et al.

(10) Patent No.: US 8,663,769 B2
(45) Date of Patent: Mar. 4, 2014

(54) BAMBOO ORIENTED STRAND BOARD AND METHOD FOR MANUFACTURING THE SAME

(75) Inventors: Shiyuan Zhang, Beijing (CN); Fangwen Zhang, Beijing (CN)

(73) Assignee: Beijing New Building Material (Group) Co., Ltd, Beijing, P.R. (CN)

( * ) Notice: Subject to any disclaimer, the term of this patent is extended or adjusted under 35 U.S.C. 154(b) by 0 days.

(21) Appl. No.: 13/807,063

(22) PCT Filed: Apr. 27, 2011

(86) PCT No.: PCT/CN2011/073403

§ 371 (c)(1),
(2), (4) Date: Dec. 27, 2012

(87) PCT Pub. No.: WO2012/003738

PCT Pub. Date: Jan. 12, 2012

(65) Prior Publication Data

US 2013/0108857 A1 May 2, 2013

(30) Foreign Application Priority Data

Jul. 6, 2010 (CN) ..... 2010 1 0226094

(51) Int. Cl.
*B27N 3/14* (2006.01)

(52) U.S. Cl.
USPC ..... 428/55; 264/113; 264/115; 144/333

(58) Field of Classification Search
None
See application file for complete search history.

(56) References Cited

U.S. PATENT DOCUMENTS

| | | | | |
|---|---|---|---|---|
| 4,810,551 | A * | 3/1989 | Chu | 428/106 |
| 5,675,951 | A * | 10/1997 | Gow | 52/287.1 |
| 5,972,467 | A * | 10/1999 | Washo | 428/107 |
| 8,389,056 | B1 * | 3/2013 | Cozzolino | 427/284 |
| 2005/0161852 | A1 * | 7/2005 | Decker et al. | 264/109 |
| 2007/0187025 | A1 * | 8/2007 | Slaven et al. | 156/256 |

(Continued)

FOREIGN PATENT DOCUMENTS

| | | | |
|---|---|---|---|
| CN | 1335217 | A | 2/2002 |
| CN | 101066603 | A | 11/2007 |
| JP | 200171303 | A | 3/2001 |

OTHER PUBLICATIONS

International Search Report for PCT/CN2011/073403 dated Jul. 18, 2011.

*Primary Examiner* — Mary F Theisen
(74) *Attorney, Agent, or Firm* — Ling Wu; Stephen Yang; Ling and Yang Intellectual Property

(57) ABSTRACT

An oriented bamboo strand board and method for manufacturing the same are provided. The method includes: (a) cutting a bamboo stalk (4) into sections (6), and splitting each section (6) into 3-12 arc bamboo blanks (8) in the radial direction; (b) removing a outer surface part (10) and inner surface part (11) of the arc bamboo blank (8) by a thicknesser; (c) flaking the bamboo blank after removal of the outer surface part (10) and inner surface part (11) into bamboo flakes (14) with a thickness of 0.1-0.3 mm in the chordwise or substantially chordwise direction; (d) applying glue to the bamboo flakes (14) after drying, and orientedly spreading. The bamboo flakes have large width, break-resistance, good flatten characteristic and easy glue application, and the mechanical strength of produced oriented bamboo strand board is 1.5-1.6 times as much as that of the oriented bamboo strand board manufactured by radial flaking.

21 Claims, 1 Drawing Sheet

(56) References Cited

U.S. PATENT DOCUMENTS

2008/0053570 A1* 3/2008 Wang ..... 144/333
2009/0308528 A1 12/2009 Sullivant
2011/0027529 A1* 2/2011 Zhang et al. ..... 428/137
2011/0293885 A1* 12/2011 Yu et al. ..... 428/136

* cited by examiner

BAMBOO ORIENTED STRAND BOARD AND METHOD FOR MANUFACTURING THE SAME

TECHNICAL FIELD

The present invention relates to the technical field of artificial board and composite material, and in particular, to a method for manufacturing an Oriented Bamboo Strand Board (OBSB).

BACKGROUND ART

Wood OSB (Oriented Strand Board) is a type of artificial board spread by staggering belt-form wood chips vertically and horizontally, and significantly exceeds common strand board and MDF (Medium-Density Fibreboard) in physical properties. Wood OSB can replace multi-layer plywood for many uses and is widely used in industries such as building, decoration, vehicle or ship manufacturing, and so on.

In order to further seek the raw materials of the oriented strand board that can replace wood, some people attempted to manufacture the oriented strand board using bamboo. Chinese patent application 200610114384.5 titled "A process of making oriented bamboo structure board" disclosed a method for manufacturing oriented strand board using bamboo, and this method adopts flaking or chipping the bamboo in the radial or substantially radial direction of the bamboo. The method mainly has the following problems:

(1) the bamboo itself is featured that its wall is thin and it is hollow, and it lacks the transversal thin-wall tissues which is different from the wood. The method for manufacturing wood slice is not suitable for manufacturing large slice of bamboo shavings, and the difficulty in industrial manufacturing is very high;

(2) the large slice of shavings is obtained using the method of flaking in the radial or substantially radial direction of the bamboo in the application. The characteristic of different growth stresses for cylindric bamboo is neglected, and the manufactured large slice of the bamboo shavings curls or cracks easily, and has poor flatten characteristic, and the difficulty in glue application is very high;

(3) the large slice of bamboo shavings manufactured by the application has the disadvantages of short bamboo fibers and more breakages, thus causing the mechanical strength of the large slice of bamboo shavings in the form of basic unit to decrease, and the physical-mechanical properties of the integrally molded board to be not ideal.

SUMMARY OF THE INVENTION

In view of the above problems existing in the prior art, the purpose of the present application is to provide an oriented bamboo strand board and a method for manufacturing the same, which not only facilitates processing and manufacturing, but also greatly improves the modulus of elasticity of the manufactured oriented strand board.

The method for manufacturing an oriented bamboo strand board of the present invention comprises the following steps:

(a) cutting a bamboo stalk into bamboo sections, and splitting each bamboo section into arc bamboo blanks in the radial direction;

(b) slicing each arc bamboo blank to remove an outer surface part and an inner surface part of the arc bamboo blank, to form a roughly sliced bamboo chip;

(c) flaking the roughly sliced bamboo chip into a plurality of bamboo flakes in the chordwise or substantially chordwise direction perpendicular to the radius of the original bamboo stalk;

(d) drying the bamboo flakes, performing surface gluing to the dried bamboo flakes, orientedly spreading the bamboo flakes after surface gluing, hot-pressing and curing, to form the bamboo oriented strand board.

In said step (a), the length of the bamboo section is suitable for spreading of bamboo flakes and operations in other steps, and meets performance requirements of the oriented bamboo strand board. When splitting the bamboo section into arc bamboo blanks in the radial direction, a number of bamboo blanks may be determined according to diameters of the various bamboo stalks so as to obtain the roughly sliced bamboo chips with an enough width in the subsequent slicing step, for example splitting into 3 to 12 bamboo blanks so as to utilize the bamboo stalks efficiently.

In said step (b), the proper inner surface part and outer surface part are removed through slicing so that the roughly sliced bamboo chips are wide enough and to utilize the bamboo stalk efficiently. A conventional or known thicknesser or chipper can be adopted for slicing.

In said step (c), the roughly sliced bamboo chips are flaked preferably parallelly or substantially parallelly into a plurality of bamboo flakes, in the chordwise or substantially chordwise direction perpendicular to the radius of the original bamboo stalk. The thickness of the bamboo flake is suitable for spreading the bamboo flakes and meets performance requirements of the oriented bamboo strand board. The thickness of the bamboo flake may be 0.1-3.0 mm. A conventional or known sectioning apparatus, such as a flaker can be adopted. Preferably, the width of the bamboo flake is 20-60 mm.

The length of the bamboo flake can be controlled within 50-3000 mm, and if the length of the bamboo flake is too long, the bamboo flake can be cut into bamboo flakes with a proper length after said step (c), for example, the length can be controlled within 50-500 mm so as to facilitate spreading.

In said step (d), the bamboo flakes are dried in a conventional or known way, and surface gluing is performed to the dried bamboo flakes in a conventional or known way. The glue used may be a conventional or known glue for manufacturing a oriented strand board, for example various commercially available phenol-formaldehyde resin (PF) glue, polyisocyanate (PMDI) glue and urea-formaldehyde resin (UF) glue. The bamboo flakes after surface gluing are spread orientedly. Spreading in a conventional or known way may be adopted, so long as an oriented bamboo strand board with required properties can be obtained. After the bamboo flakes with gluing are spread, hot-pressing and curing is performed according to the hot-pressing and curing conditions of the glue used so as to obtain the oriented bamboo strand board with required properties.

The present invention further provides an oriented bamboo strand board, which is manufactured by the above method for manufacturing an oriented bamboo strand board of the present invention.

In addition, a kind of oriented bamboo strand board of the present invention comprises bamboo flakes flaked in the chordwise or substantially chordwise direction perpendicular to the radius of a bamboo stalk, and a plurality of said bamboo flakes are spread orientedly into a plate form after gluing and then hot-pressed and cured.

Wherein, the bamboo flakes, after gluing, are transversally orientedly spread into a transversally oriented spreading layer, and are longitudinally orientedly spread into a longitudinally oriented spreading layer, and the transversally oriented spreading layer and the longitudinally oriented spreading layer can be staggered and superposed in turn and glued together by hot-pressing; or they can be spread in other ways.

The bamboo flakes can be produced by way of the aforesaid steps (a), (b) and (c) of this text. The thickness of the bamboo flake may be 0.1-3.0 mm. The width of the bamboo flake may be 20-60 mm. Other widths and thicknesses not within the aforesaid scopes may also be selected according to the desired various properties of the oriented bamboo strand board.

The present invention has the following advantages:

1) the bamboo flake for orientedly spread material formed in the chordwise or substantially chordwise direction not only has a large width, which may be up to 60 mm, but also is shatter resistant, has a good flatten characteristic, and easy glue application with a small amount of glue;

2) the surface flaking orientation of the oriented bamboo stand board (OBSB) orientedly spread in the chordwise or substantially chordwise direction is even and very obvious;

3) upon mechanical property detection, the mechanical strength of the oriented bamboo stand board (OBSB) manufactured by chordwise flaking is higher than that of the radial bamboo oriented strand board by about 50-60%, and its mechanical property is more prominent;

4) industrial continuous production can be achieved to replace the out-dated bamboo plywood production.

PREFERRED EMBODIMENTS OF THE PRESENT INVENTION

A method for manufacturing an oriented bamboo strand board according to the present invention will be described in detail below with reference to FIG. 1, so that a person skilled in the art can carry out the present invention. It should be understood that other embodiments can be adopted and proper modifications can be made without departing from the spirit or scope of the present invention. In order to avoid details unnecessary for a person skilled in the art to carry out the present invention, certain information that is known to a person skilled in the art may be omitted in the description. Therefore, the following detailed description cannot be construed in the sense of limitation, and the scope of the present invention is only defined by the attached claims.

In the method for manufacturing an oriented bamboo strand board according to the present invention, the bamboo stalk used may be various suitable bamboo stalks known to a person skilled in the art that can be used as oriented bamboo strand boards, such as moso bamboo, black bamboo, mottled bamboo, phyllostachys pubescens and so on.

Figure 1:
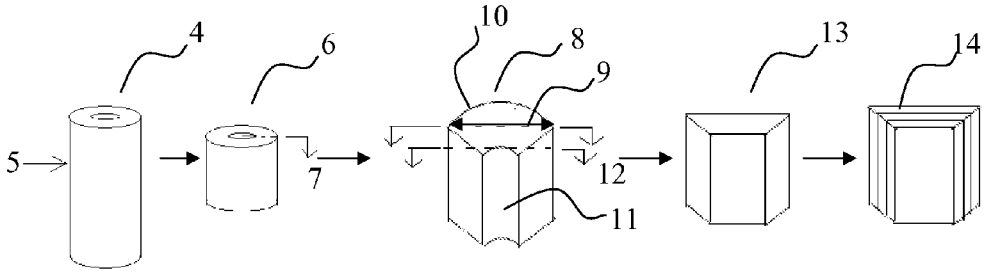
FIG. 1 illustrates a schematic diagram of the process of manufacturing bamboo flakes of the present invention.

As shown in FIG. 1, the oriented bamboo strand board of the present invention is specifically manufactured through the following steps:

step a) cutting a bamboo stalk 4 into bamboo sections 6 in the direction of arrow 5, and a person skilled in the art can determine the lengths of the bamboo sections 6 as required; splitting the bamboo sections 6 into 3 to 12 equant arc bamboo blanks 8 respectively in the radial direction (as shown by arrow 7) according to the size of the diameter, and the chord length (i.e., the distance shown by the bidirectional arrow 9 in FIG. 1) of the arc bamboo blank 8 is 20-60 mm;

step b) feeding each arc bamboo blank 8 into a thicknesser for slicing so as to remove a outer surface part 10 and inner surface part 11 of the arc bamboo blank 8, thereby forming a roughly sliced bamboo chip 13 (the direction of slicing is the chordwise or substantially chordwise direction shown by arrow 12);

step c) flaking the roughly sliced bamboo chip 13 after removal of the outer surface part 10 and inner surface part 11 into a plurality of bamboo flakes 14 by a flaker in the chordwise or substantially chordwise direction perpendicular to the radius of the original bamboo stalk; wherein, FIG. 1 only illustratively shows three bamboo flakes 14, and its quantity is determined by the thickness of the required bamboo flake and the thickness of the roughly sliced bamboo chip 13, for example, the thickness may be controlled within the range of 0.1-3.0 mm; wherein, the width of the bamboo flake 14 may be controlled within the range of 5-60 mm, preferably 20-60 mm, and the larger the width, the more favorable for oriented spreading; in addition, the length of the bamboo flake 14 may be controlled within the range of 50-3000 mm, and if the length of the bamboo flake 14 is very large, the bamboo flake 14 may be cut into bamboo flakes with a proper length, for example, the length may be controlled within the range of 50-500 mm so as to facilitate spreading;

step d) drying the bamboo flakes 14 until reaching an absolute moisture content of 1-10%, and then performing surface gluing. In this step, the technique and device, for example, a cylindrical drier, known to a person skilled in the art are adopted to dry the bamboo flakes; the technique and device, for example, a glue mixer, known to a person skilled in the art are adopted to perform surface gluing, and the adhesive used during the process of surface gluing is an adhesive known to a person skilled in the art, for example phenol-formaldehyde resin (PF) glue, polyisocyanate (PMDI) glue and urea-formaldehyde resin (UF) glue;

step e) performing oriented spreading, then forming board blank by way of layered spreading with longitudinal layers and transversal layers, and finally placing the board blank into a hot press to be cured into a molded board, thereby obtaining the oriented bamboo strand board of the present invention.

Figure 2:
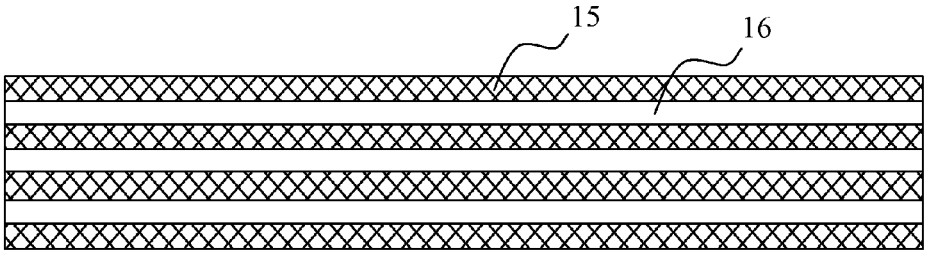
FIG. 2 illustrates a schematic diagram of the structure of an oriented bamboo strand board of the present invention.

The oriented bamboo strand board manufactured according to the manufacturing method of the present invention is shown in FIG. 2, comprising: transversally oriented spreading layers 15 and longitudinally oriented spreading layers 16, wherein the transversally oriented spreading layers 15 and the longitudinally oriented spreading layers 16 are staggered and superposed in turn and glued together by hot-pressing; the transversally oriented spreading layers 15 and the longitudinally oriented spreading layers 16 are formed respectively through oriented spreading of bamboo flakes, which are precisely the bamboo flakes produced through the above steps.

Upon mechanical property detection, the mechanical strength of the oriented bamboo stand board (OBSB) manufactured by chordwise flaking in the present invention is higher than that of the radial bamboo oriented strand board by about 50-60%.

Table 1 shows the detection results of the properties of the oriented bamboo strand board of level OSB4 manufactured by the manufacturing method of the present invention, wherein the detection of static bending intensity, flexural elastic modulus, internal bond strength, 24-hour thickness swelling and moisture content are detected based on the method provided in forestry industry standard LY/T 1580-2000 of the People's Republic of China, and the detection of formaldehyde emission is based on GB 18580-2001. The standard values in the table are standards provided in the forestry industry standard LY/T 1580-2000 of the People's Republic of China for judging whether the detected samples are qualified or not:

TABLE 1

Detection results of the properties of the oriented bamboo strand board of level OSB4

| | Static bending intensity(Mpa) | | Flexural elastic modulus (Mpa) | | Internal bond strength | 24-hour thickness swelling | Moisture content | Formaldehyde emission (mg/100 g |
|---|---|---|---|---|---|---|---|---|
| | parallel | vertical | parallel | vertical | (Mpa) | (%) | (%) | board) |
| Detection results | 61.3 | 62.6 | 7310 | 5860 | 1.41 | 4.8 | 5.7 | 0.1 |
| Standard values | ≥28 | ≥15 | ≥4800 | ≥1900 | ≥0.45 | ≤12 | 5~12 | ≤9 |

Industrial Applicability

In the present invention, the bamboo flakes for orientedly spread material formed in the chordwise or substantially chordwise direction does not only has a large width, which may be up to 60 mm, but also is shatter resistant, has a good flatten characteristic, and easy glue application with a small amount of glue; the surface flaking orientation of the oriented bamboo stand board orientedly spread in the chordwise or substantially chordwise direction is even and very obvious; upon mechanical property detection, the mechanical strength of the oriented bamboo stand board (OBSB) manufactured by chordwise flaking is higher than that of the radial bamboo oriented strand board by about 50-60%, and its mechanical property is more prominent; industrial continuous production can be achieved to replace the out-dated bamboo plywood production.

What is claimed is:

1. A method for manufacturing an oriented bamboo strand board, comprising the following steps:

(a) cutting a bamboo stalk (4) into bamboo sections (6), and splitting each bamboo section (6) into arc bamboo blanks (8) in the radial direction;

(b) slicing each arc bamboo blank (8) to remove an outer surface part (10) and an inner surface part (11) of the arc bamboo blank (8), to form a roughly sliced bamboo chip (13);

(c) flaking the roughly sliced bamboo chip (13) into a plurality of bamboo flakes (14) in the chordwise or substantially chordwise direction perpendicular to the radius of the original bamboo stalk (4);

(d) drying the bamboo flakes (14), performing surface gluing to the dried bamboo flakes, orientedly spreading the bamboo flakes after surface gluing, hot-pressing and curing, to form the bamboo oriented strand board.

2. The method according to claim 1, wherein, in said step (a), said bamboo section (6) is split into 3 to 12 bamboo blanks.

3. The method according to claim 1, wherein, in said step (b), said bamboo blank (8) is sliced by a thicknesser.

4. The method according to claim 1, wherein, the thickness of said bamboo flake flaked in said step (c) is 0.1-3.0 mm.

5. The method according to claim 1, wherein, in said step (c), the roughly sliced bamboo chip (13) is flaked into bamboo flakes (14) by a flaker.

6. The method according to claim 1, further comprising: cutting each flaked bamboo flake short after said step (c) so as to facilitate spreading.

7. The method according to claim 6, wherein, the length of the shortcut bamboo flake is 50-500 mm.

8. The method according to claim 1, wherein, the width of the bamboo flake (14) is 20-60 mm.

9. The method according to claim 1, wherein, in said step (d), the glue is one or more of glues selected from phenol-formaldehyde resin (PF) glue, polyisocyanate (PMDI) glue and urea-formaldehyde resin (UF) glue.

10. An oriented bamboo strand board, manufactured by the method for manufacturing an oriented bamboo strand board described in claims 1.

11. An oriented bamboo strand board, comprising:

a plurality of bamboo flakes (14), a plurality of said bamboo flakes (14) being spread orientedly into a plate form after gluing and then hot-pressed and cured;

wherein a plurality of said bamboo flakes is formed by:

cutting a bamboo stalk (4) into bamboo sections (6), and splitting each bamboo section (6) into arc bamboo blanks (8) in the radial direction;

slicing each arc bamboo blank (8) to remove an outer surface part (10) and an inner surface part (11) of the arc bamboo blank (8), to form a roughly sliced bamboo chip (13);

flaking the roughly sliced bamboo chip (13) into a plurality of said bamboo flakes (14) in the chordwise or substantially chordwise direction perpendicular to the radius of the original bamboo stalk (4).

12. The oriented bamboo strand board according to claim 11, wherein, the bamboo flakes, after gluing, are transversally orientedly spread into a transversally oriented spreading layer (15), and are longitudinally orientedly spread into a longitudinally oriented spreading layer (16), and the transversally oriented spreading layer (15) and the longitudinally oriented spreading layer (16) are staggered and superposed in turn and glued together by hot-pressing.

13. The oriented bamboo strand board according to claim 11, wherein, the thickness of the bamboo flake is 0.1-3.0 mm.

14. The oriented bamboo strand board according to claim 11, wherein, the width of the bamboo flake is 20-60 mm.

15. The method according to claim 2, wherein, the width of the bamboo flake (14) is 20-60 mm.

16. The method according to claim 3, wherein, the width of the bamboo flake (14) is 20-60 mm.

17. The method according to claim 4, wherein, the width of the bamboo flake (14) is 20-60 mm.

18. The method according to claim 5, wherein, the width of the bamboo flake (14) is 20-60 mm.

19. The method according to claim 6, wherein, the width of the bamboo flake (14) is 20-60 mm.

20. The method according to claim 7, wherein, the width of the bamboo flake (14) is 20-60 mm.

21. The method according to claim 6, further comprising:

after gluing the bamboo flakes, transversally orientedly spreading the bamboo flakes into a transversally oriented spreading layer (15), and longitudinally orientedly spreading the bamboo flakes into a longitudinally oriented spreading layer (16), wherein the transversally oriented spreading layer (15) and the longitudinally oriented spreading layer (16) are staggered and superposed in turn and glued together by hot-pressing.

* * * * *